US008157413B2

(12) United States Patent
Maxik et al.

(10) Patent No.: US 8,157,413 B2
(45) Date of Patent: Apr. 17, 2012

(54) LIGHT FIXTURE AND ASSOCIATED LED BOARD AND MONOLITHIC OPTIC

(75) Inventors: Fredric S. Maxik, Indialantic, FL (US); Zach Gibler, Granville, OH (US); Eric Bretschneider, Clarkston, MI (US); David Henderson, Indialantic, FL (US); Addy Widjaja, Palm Bay, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 142 days.

(21) Appl. No.: 12/687,710

(22) Filed: Jan. 14, 2010

(65) Prior Publication Data

US 2010/0188850 A1 Jul. 29, 2010

Related U.S. Application Data

(60) Provisional application No. 61/147,389, filed on Jan. 26, 2009.

(51) Int. Cl.
*F21V 5/00* (2006.01)

(52) U.S. Cl. ..... 362/244; 362/326; 362/294; 362/431

(58) Field of Classification Search ..... 362/145, 362/153.1, 294, 373, 218, 233, 431
See application file for complete search history.

(56) References Cited

U.S. PATENT DOCUMENTS

| | | | | |
|---|---|---|---|---|
| 7,204,608 | B2 * | 4/2007 | Beeman et al. | 362/233 |
| 7,566,150 | B2 * | 7/2009 | Adrien | 362/418 |
| 7,959,331 | B2 * | 6/2011 | Ho | 362/373 |
| 2003/0201874 | A1 | 10/2003 | Wu | |
| 2004/0257006 | A1 | 12/2004 | Beeman et al. | |
| 2009/0016055 | A1 * | 1/2009 | Liu et al. | 362/252 |
| 2009/0034257 | A1 * | 2/2009 | Liu et al. | 362/252 |

FOREIGN PATENT DOCUMENTS

FR 2908500 A1 5/2008

OTHER PUBLICATIONS

English Abstract for France Publication No. 2908500; Publication date: May 16, 2008; 1 pg.
European Search Report for Application No. 10151159.0-1268; Date of Mailing: May 11, 2010; 6 pgs.

* cited by examiner

*Primary Examiner* — Ali Alavi
(74) *Attorney, Agent, or Firm* — Cantor Colburn LLP

(57) ABSTRACT

An embodiment of the invention is directed to a light fixture useful for area lighting. The light fixture includes a housing having a base and a top, and a light emitting diode (LED) light emission module disposed within the housing. The light emission module includes a centrally disposed aperture that receives a centrally disposed power lead for powering the light emission module.

25 Claims, 10 Drawing Sheets

LIGHT FIXTURE AND ASSOCIATED LED BOARD AND MONOLITHIC OPTIC

CROSS REFERENCE TO RELATED APPLICATIONS

This application claims the benefit of U.S. Provisional Application Ser. No. 61/147,389, filed Jan. 26, 2009, which is incorporated herein by reference in its entirety.

BACKGROUND OF THE INVENTION

The present disclosure relates generally to a light fixture and associated LED (light emitting diode) board and monolithic optic useful for area lighting or street lighting, and particularly to an LED-based street light fixture capable of generating a Type-III emission pattern at the ground level.

Conventional street lights include acorn type light fixtures and cobra type light fixtures, with the acorn type fixtures typically casting light from a light source in a uniform distribution around a central vertical axis (the lamp post for example) toward the street, and the cobra type fixtures typically casting light in a uniform downward distribution toward the street from an overhanging light source. With light fixtures having unmodified light distribution, the light emission pattern on one side of the fixture is substantially identical to the light emission pattern on an opposite side of the fixture. For acorn type light fixtures, such a uniform light emission pattern at the ground level is an inefficient use of light and energy where more light on the street side of the lamppost and less light on the house side of the lamppost is desired. Also with respect to energy usage, streetlights that employ high-pressure sodium (HPS) technology can still require a substantial amount of energy that can be overly burdensome to the tax base of municipalities employing many street light fixtures.

In an effort to overcome each of the aforementioned drawbacks, an LED solution employing a Type-III emission pattern (more light directed toward the street side and less light directed toward the house side) has been sought after, with the energy efficiency of LED's serving to keep energy demands under control, and the use of a specific emission pattern also serving to keep energy demands under control by directing the light to where it is more useful and less objectionable. For street lighting, however, and in view of the limited lumen output of a single LED compared with the cost of many LED's, an efficient arrangement utilizing a plurality of LED's within a single light fixture, such as an acorn light fixture, along with directed light emission, is desirable for advancing the art of LED street lighting and overcoming the aforementioned drawbacks.

BRIEF DESCRIPTION OF THE INVENTION

An embodiment of the invention is directed to a light fixture useful for area lighting. The light fixture includes a housing having a base and a top, and a light emitting diode (LED) light emission module disposed within the housing. The light emission module includes a centrally disposed aperture that receives a centrally disposed power lead for powering the light emission module.

Another embodiment of the invention is directed to an LED board useful for area lighting, which may be employed in the above-noted light fixture or another light fixture. The LED board includes a monolithic substrate having a first side and a second side, the first side having a plurality of LED's arranged in groups, each group being defined by a separate subset of the plurality of LED's, each group of LED's being electrically connected in parallel with each other group, and each of the LED's within a group being electrically connected in series with each other LED within the respective group.

Another embodiment of the invention is directed to a monolithic optic useful for area lighting employing a plurality of LED's, which may be employed in the above-noted light fixture or another light fixture. The monolithic optic includes a common platform having a first side configured to orient toward the LED's and a second side configured to orient toward the ground, and a plurality of convex lenses disposed on the second side in a one-to-one corresponding relationship with respect to the plurality of LED's. Each of the lenses has a same shape.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention, as shown and described by the various figures and accompanying text, provides an acorn LED light fixture useful for area lighting with a Type-III emission pattern at the ground level. While the embodiment described herein depicts an acorn light fixture as an exemplary light source, it will be appreciated that the disclosed invention is also applicable to other light sources, such as a cobra light fixture, for example. While embodiments described herein may be useful for providing Type-III light distribution, it will be appreciated that other emission patterns such as Types-I, II, IV and V may also be achieved by employing the teachings disclosed herein. While embodiments are described herein with reference to street lighting, it will be appreciated that such embodiments will also be applicable for the lighting of areas other than a street. As such, any reference herein to street lighting should not be construed as a limitation to the utility of embodiments of the invention.

Figure 1:
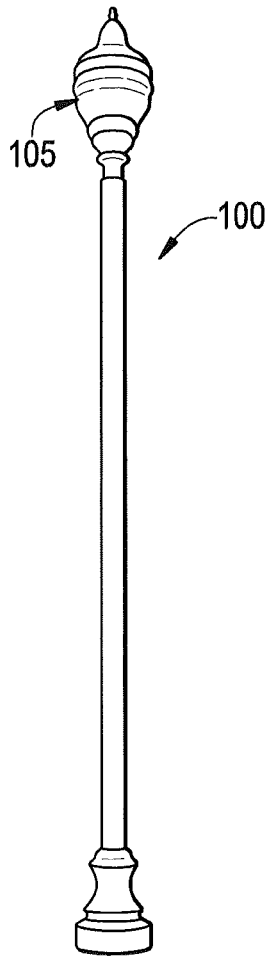
FIG. 1 depicts an example embodiment of a light (fixture and pole) for use in accordance with an embodiment of the invention.

FIG. 1 depicts an exemplary embodiment of a light (fixture and pole) 100 having an acorn type light fixture 105. The acorn light fixture 105 is depicted further in FIG. 2 with a light emission module 110 depicted in dashed lines (to be discussed in more detail below), and with a centrally disposed power lead 115, also depicted in dashed lines, for powering the light emission module 110. In an embodiment, the light fixture 105 has a housing 120 that includes a base 125 and a top 130, where the light emission module 110 is disposed within the housing 120 coupled to and supported by either of the base 125 or the top 130 by means that will be discussed further below. In an embodiment, the light emission module 110 is a light emitting diode (LED) light emission module having a centrally disposed aperture (best seen by referring to FIG. 3) configured to receive the centrally disposed power lead 115.

Figure 2:
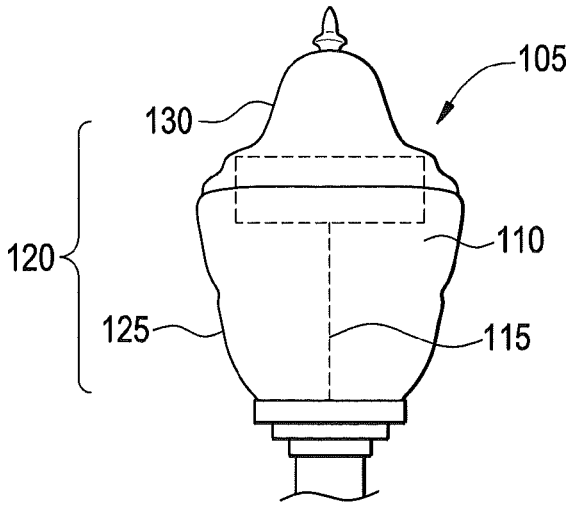
FIG. 2 depicts an example acorn light fixture, with a light emission module depicted in dashed lines, for use in accordance with an embodiment of the invention.
Figure 3:
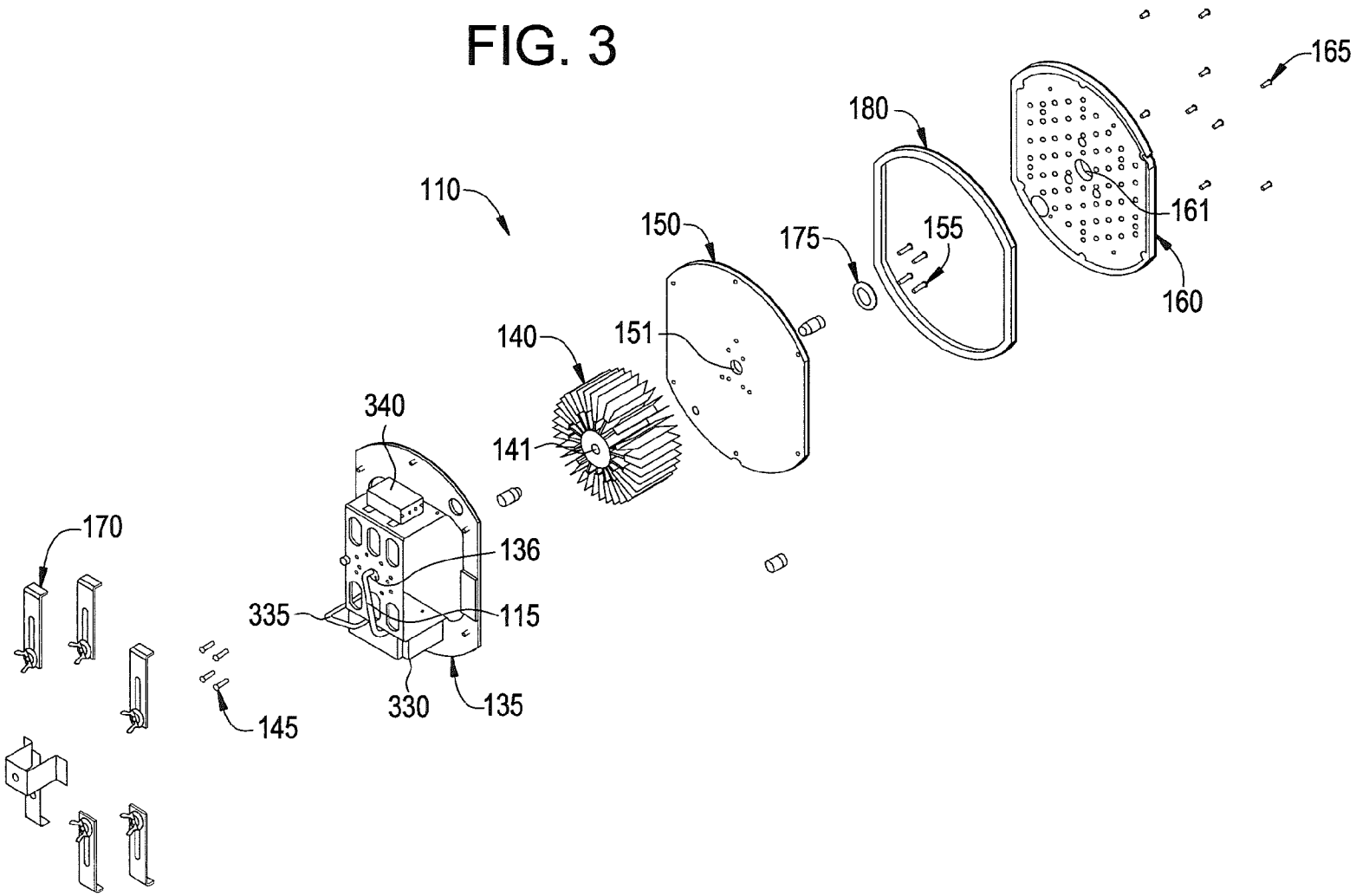
FIGS. 3-6 respectively depict an exploded assembly drawing, a back isometric drawing, a back view drawing, and a side view drawing, of an embodiment of a LED light emission module in accordance with an embodiment of the invention.
Figure 4:
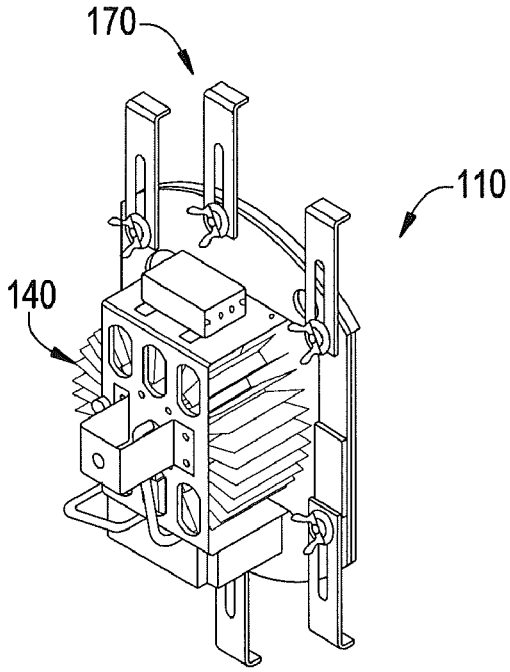
Figure 5:
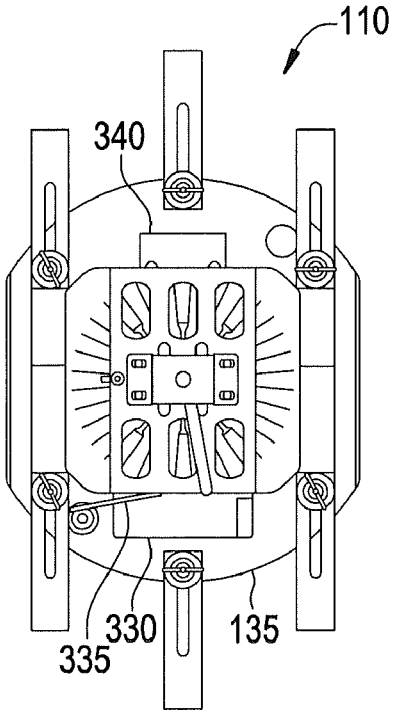
Figure 6:
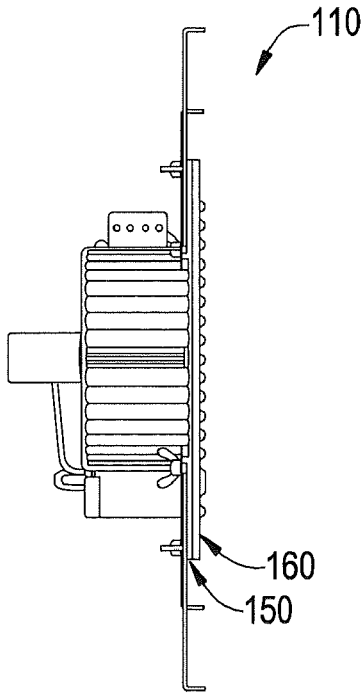

Reference is now made to FIGS. 3-6 collectively, where FIG. 3 is an exploded assembly drawing, FIG. 4 is a back isometric drawing, FIG. 5 is a back view drawing, and FIG. 6 is a side view drawing, of an embodiment of the LED light emission module 110, which includes a support 135, a radial fin heat sink 140 coupled to the support 135 via fasteners 145, an LED board 150 coupled to the heat sink via fasteners 155, and a monolithic optic 160 disposed proximate and coupled to the LED board 150 via fasteners 165. In an embodiment, the monolithic optic 160 is formed of polycarbonate. One or more, and in an embodiment all, of the monolithic optic 160, the LED board 150, the heat sink 140 and the support 135, include a centrally disposed aperture 161, 151, 141 and 136, respectively, configured to receive the centrally disposed power lead 115 (only a segment being illustrated in FIG. 3) for powering the light emission module 110. Brackets 170 may be attached to support 135 for attaching the support 135, and light emission module 110 generally, to the housing 120 of light fixture 105, thereby providing universal mounting for a variety of light fixture designs. In an embodiment, the support 135 and brackets 170 are suitable for connecting the light emission module 110 to any shaped light fixture 105, such as a circular, square, hexagonal or octagonal fixture for example, and are suitable for mounting the light emission module 110 at the top of the light fixture 105, as illustrated in FIG. 2 for example, or at the bottom of the light fixture 105. Gaskets 175, 180 may be employed and disposed within respective gasket-receiving features to provide an adequate weather seal between the monolithic optic 160 and the LED board 150, however, it is contemplated that adequate weather sealing may also be attainable using a curable sealant in place of one or both of the gaskets 175, 180.

Figure 7:
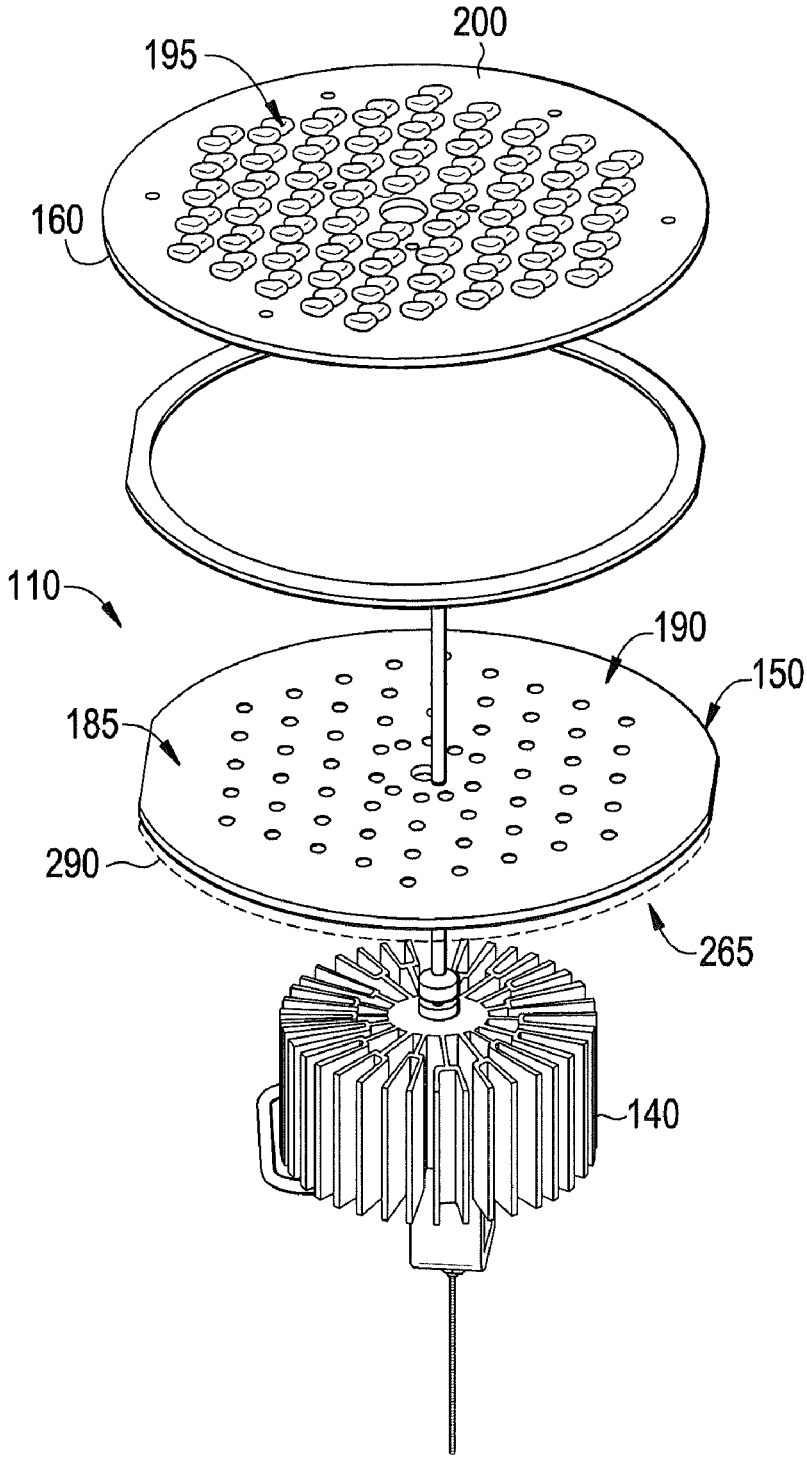
FIGS. 7 and 8 respectively depict an exploded assembly drawing and a front isometric drawing of an embodiment of the LED light emission module in accordance with an embodiment of the invention.
Figure 8:
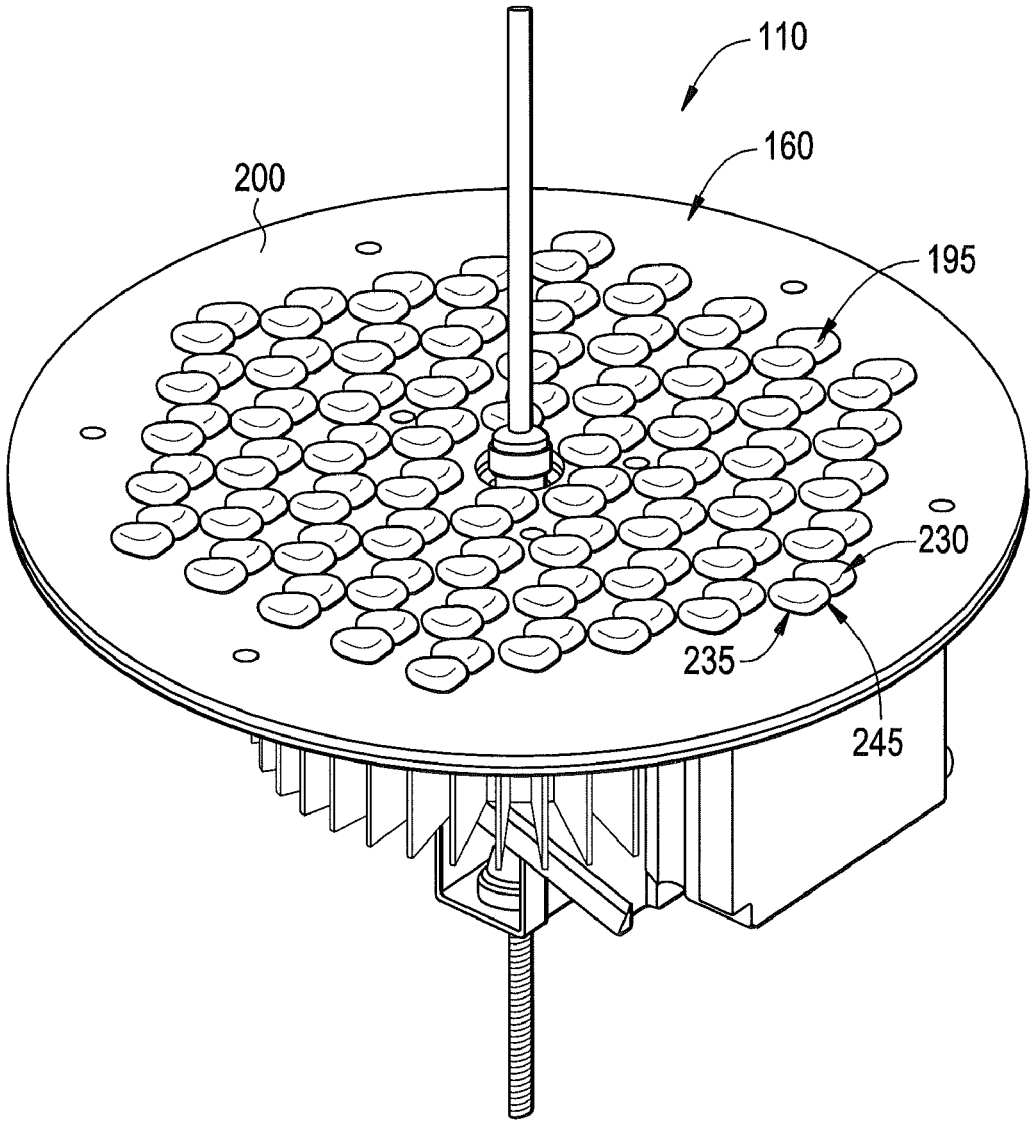

Referring now to FIGS. 7 and 8, where FIG. 7 is an exploded assembly drawing and FIG. 8 is a front isometric drawing of an embodiment of the LED light emission module 110, the LED board 150 includes a plurality of LED's 185 disposed on a front side 190 of LED board 150, and the monolithic optic 160 includes a plurality of lenses 195 disposed on a front side 200 (also herein referred to as the street side) of monolithic optic 160, with each of the lenses 195 being associated and aligned with a corresponding one of the LED's 185. Each lens 195 in combination with its corresponding LED 185 produces a same emission pattern oriented in a same direction as every other pair of lens 195 and LED 185 such that a Type-III emission pattern results on the ground at the street level from each pair of lens 195 and LED 185, and from the aggregate of all pairs of lenses 195 and LED's 185. As such, loss of light from a single or a group of LED's 185 does not change the overall emission pattern, but only slightly decreases the overall light intensity by a defined amount.

Figure 9:
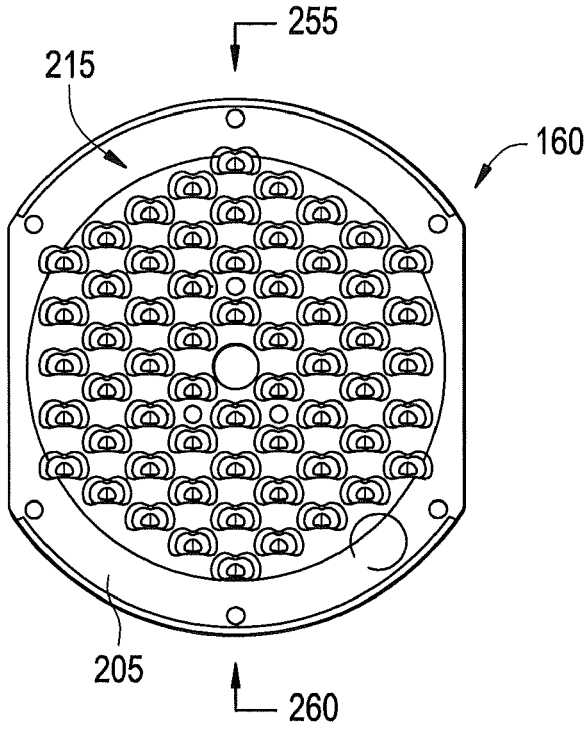
FIGS. 9-13 respectively depict a front plan view, a back plan view, a first section view, a second section view and a third section view, of a monolithic optic in accordance with an embodiment of the invention.
Figure 10:
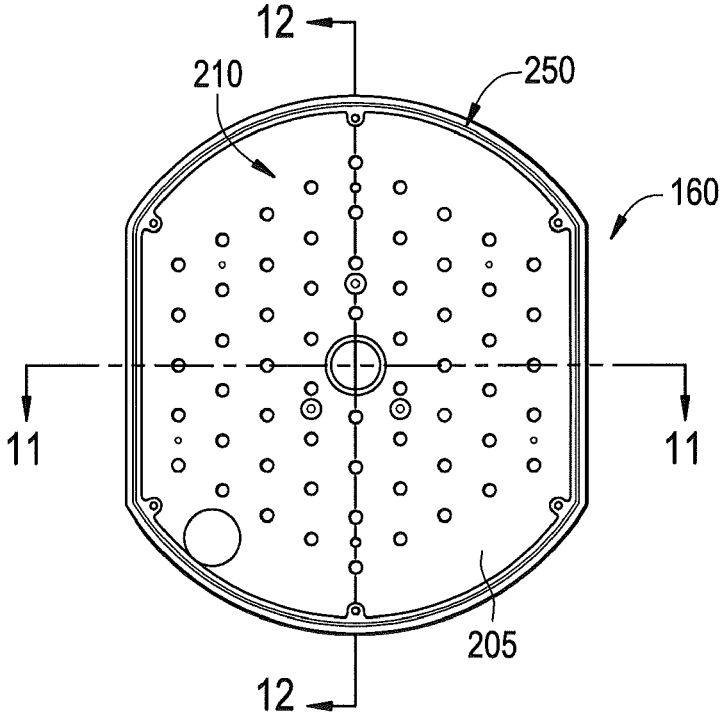
Figure 11:
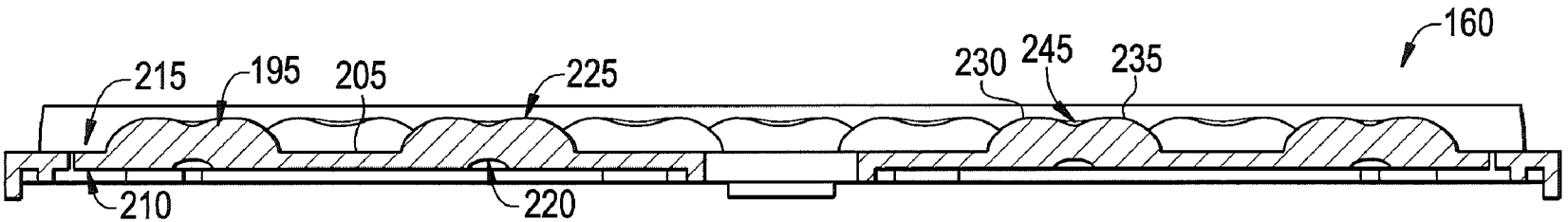
Figure 12:
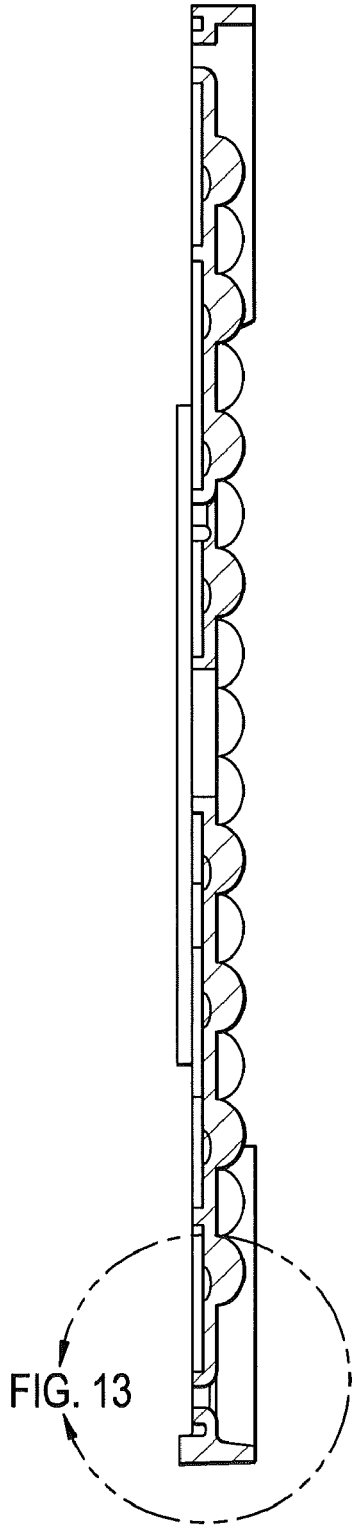
Figure 13:
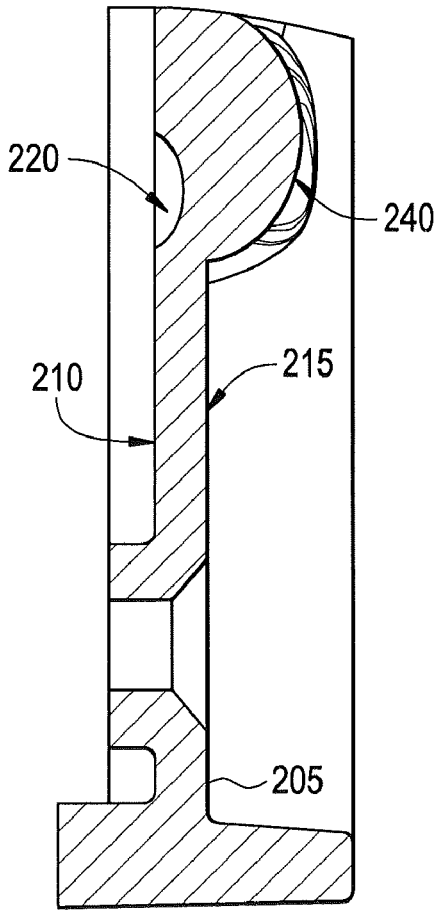

Further description of how the monolithic optic 160 produces this Type-III emission pattern will now be made with reference to FIGS. 9-13, where FIG. 9 is a front plan view, FIG. 10 is a back plan view, and FIGS. 11-13 are various section views of the monolithic optic 160. In an embodiment, monolithic optic 160 is formed with a common platform 205 having a first side 210 configured to orient toward the LED's 185 and a second side (street side) 215 configured to orient toward the street. In an embodiment, the common platform 205 defines a planar surface. The plurality of lenses 195 form concave lens profiles (dimples) 220 disposed on the first side 210, and convex lens profiles 225 disposed on the second side 215, in a one-to-one corresponding relationship with respect to the plurality of LED's 185, with each of the lenses 195 having the same shape and the same respective optical portions that are configured to direct light in the same direction. More specifically, each of the lenses 195 has a same first cross-section (see FIG. 11 for example) and a same second cross-section (see FIGS. 12 and 13 for example), where the first and second cross-sections are orthogonal to each other. As can be seen in the first cross-section of FIG. 11, each lens 195 has a centrally disposed dimple 220 (also referred to above as a concave lens profile) on the first side 210 of the common platform 205 with respect to two symmetrically disposed convex lobes 230, 235 (also referred to above as a convex lens profile 225) on the second side 215 of the common platform 205. Also, as can be seen in the second cross-section of FIG. 12 and the expanded detail of FIG. 13, each lens 195 has the aforementioned dimple 220 non-centrally disposed on the first side 210 of the common platform 205 with respect to a single asymmetrically disposed convex lobe 240 on the second side 215 of the common platform 205. The overall shape formed by the convex lobes 230, 235, 240 and the concave dimple 220 is best seen by referring back to FIG. 8, which illustrates in isometric view a plurality of lenses 195 each having two lobes 230, 235 (see also FIG. 11) symmetrically disposed about a valley 245 (see also FIG. 11). The light from an LED 185 disposed at the first side 210 proximate a respective dimple 220 passes through the respective lens 195 (lobes 230, 235, 240) in such a manner as to be directed more toward the street side 255 of the light fixture 105 than toward the house side 260 so as to provide a Type-III emission pattern, as discussed previously.

Notwithstanding the foregoing discussion of Type-III light distribution, it will be appreciated that alternative optics (not shown) may be used in place of optic 160 to provide any desired type of emission pattern, such as Type-I, II, III, IV or V light distribution for example. Accordingly, the scope of non-limiting inventions disclosed herein are not intended to be limited to Type-III light distribution only.

For weather sealing, also discussed previously, the first side 210 of common platform 205 optionally includes an endless gasket-receiving feature 250, such as a recessed track for example, formed within and disposed proximate to the perimeter of the common platform 205.

Figure 14:
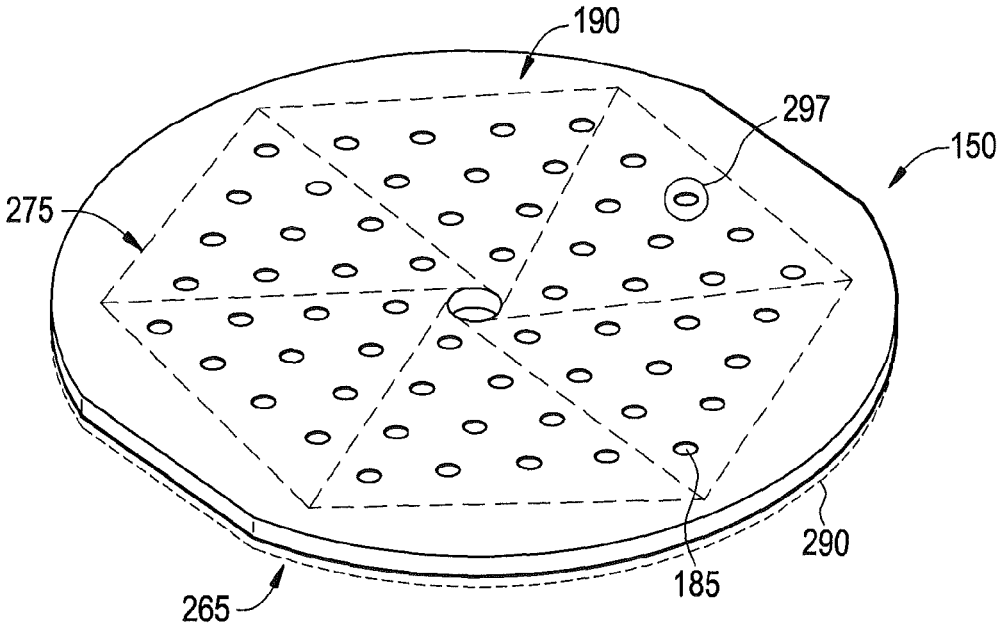
FIGS. 14 and 15 respectively depict an isometric front view and a back plan view of an LED board in accordance with an embodiment of the invention.
Figure 15:
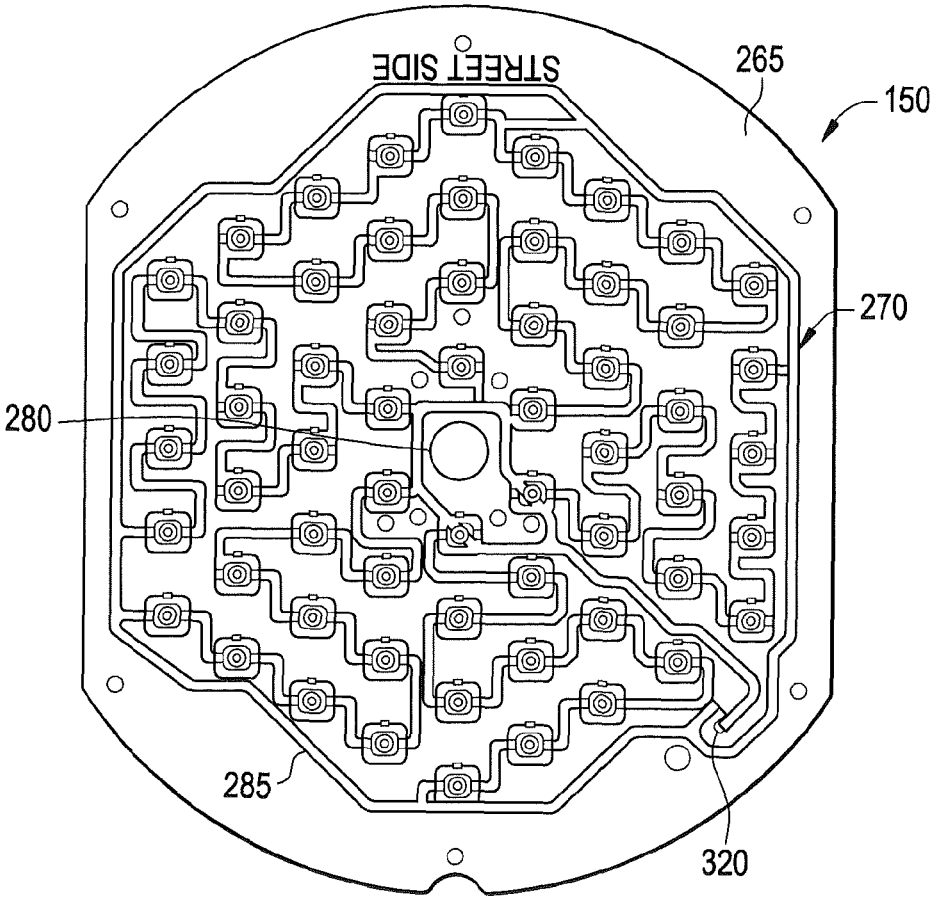

The LED board 150 will now be discussed with reference to FIGS. 14 and 15, where FIG. 14 depicts an isometric view of the front (first) side 190 illustrating the plurality of LED's 185 aligned in one-to-one correlation with the dimples 220 on the first side 210 of monolithic optic 160, and FIG. 14 depicts a plan view of the back (second) side 265 illustrating the electrical traces 270 for powering the LED's 185. In an embodiment, the LED board 150 is made from a monolithic substrate, where the LED's 185 disposed on the first side 190 are arranged in groups 275, with each group 275 being defined by a separate subset of the plurality of LED's 185, with each group 275 of LED's 185 being electrically connected in parallel with each other group 275, and with each of the LED's 185 within a group 275 being electrically connected in series with each other LED 185 within the respective group 275. The electrical connection of LED's 185 within a group 275, and between groups 275, can be seen by careful examination of the electrical traces 270 depicted in FIG. 15. For example, the central most LED 185 of a given group 275 is electrically connected on one side to a positive electrical bus 280, and the outermost LED 185 of a respective given group 275 is electrically connected on an opposing side to a negative electrical bus 285, with each LED 185 within the respective group being electrically connected in series. As such, light emission from all LED's 185 within a given group 275 will be lost in response to one of the LED's 185 within the given group 275 being non-functional (open circuited or burned out, for example). Power to the positive and negative electrical buses 280, 285 is made via contact pad 320, which is discussed further below in connection with FIG. 17. In an embodiment, and as illustrated in FIGS. 14 and 15, the plurality of LED's 185 are arranged in six triangular shaped groups 275 of LED's arranged in a hexagon pattern. As further illustrated in FIGS. 14 and 15, an embodiment includes sixty LED's 185 arranged in six groups 275 of ten LED's each. In an embodiment, each group 275 of LED's 185 has the same number of LED's. While embodiments of the invention depict a certain arrangement of groups of LED's, and a certain number of LED's within a group, it will be appreciated that this is for illustrative purposes only, and that the scope of the invention contemplates and encompasses other counts of LED's within a group, and other arrangements of groups (pentagon, octagon, to name a few for example). To produce the Type-III emission pattern discussed above, an embodiment includes an arrangement of LED's 185 where each LED of the plurality of LED's all point in the same direction.

In an embodiment, the light emission module 110 disclosed herein does not include current regulation, which is typically employed in other existing LED light fixtures, and as discussed above, loss of light from a group of LED's 185 does not change the overall emission pattern, but only slightly decreases the overall light intensity by a defined amount. In an embodiment, such a defined amount can be determined from statistical averaging and the central limit theorem, where the forward voltage across each group of LED's (a group of ten LED's for example) remains fixed regardless of the number of parallel-connected groups of LED's that remain functional. For example, even though failure of a single LED within a group will eliminate the entire group (16.7% of all LED's for an arrangement of six groups of ten), the current increase in the remaining five strings (groups) increases the emission of those remaining groups so that the overall intensity loss is only 5%. Loss of two groups (33.3%) is estimated to result in only an 11% loss in overall intensity. As such, the embodiment disclosed herein provides for self-regulating light emission without the need for a current regulator.

Figure 16:
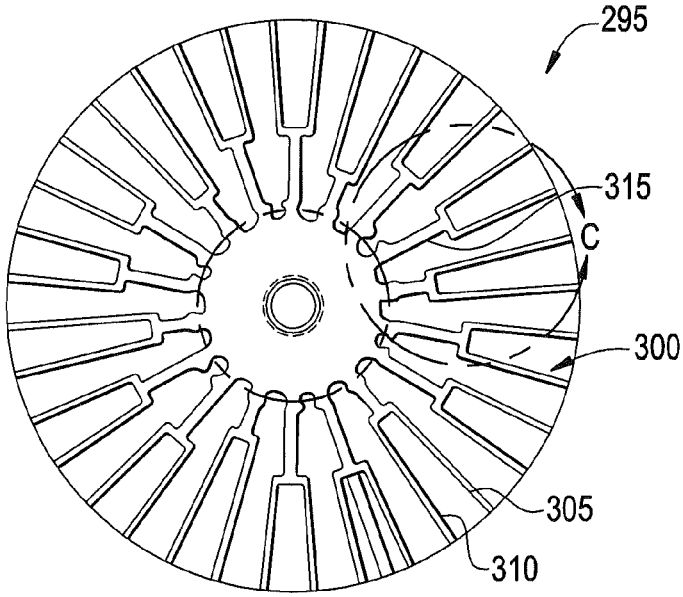
FIG. 16 depicts an example extrusion cross section for a heat sink in accordance with an embodiment of the invention.

To facilitate heat transfer from the LED's 185 to the heat sink 140, a thermally conductive layer 290 (see FIGS. 7 and 14 for example), such as aluminum for example, may be disposed across the entire surface area of the second side 265 of the LED board 150, where this thermally conductive layer 290 is disposed adjacent to and in intimate thermal communication with the heat sink 140. In an embodiment, the heat sink 140 is a radial fin heat sink formed from an extrusion with planar cutoff ends. As seen by reference to FIG. 7, one of the planar ends of heat sink 140 interfaces with the conductive layer 290 on the second side 265 of LED board 150. At a plane defined by the interface of the LED board 150 and the heat sink 140, the LED board 150 has an outside profile that shadows the outside profile of the heat sink 140. That is, the LED board 150 has a larger girth than the heat sink 140. The combination of a thermally conductive layer 290 and a smaller heat sink 140 provides for smaller packaging than other typical LED light fixtures suitable for street lighting. An example extrusion cross section 295 for heat sink 140 is depicted in FIG. 16, which illustrates a plurality of fins 300 formed having two extension fins 305, 310 extending off of a root fin 315. As can be seen, the extension fins 305, 310 may vary in length according to desired performance characteristics.

To provide for a desired color emission spectrum from the plurality of LED's 185, a light transmissible encapsulate 297 (see FIG. 14 for example) possessing desired color rendition properties may be disposed over each of the LED's 185.

Figure 17:
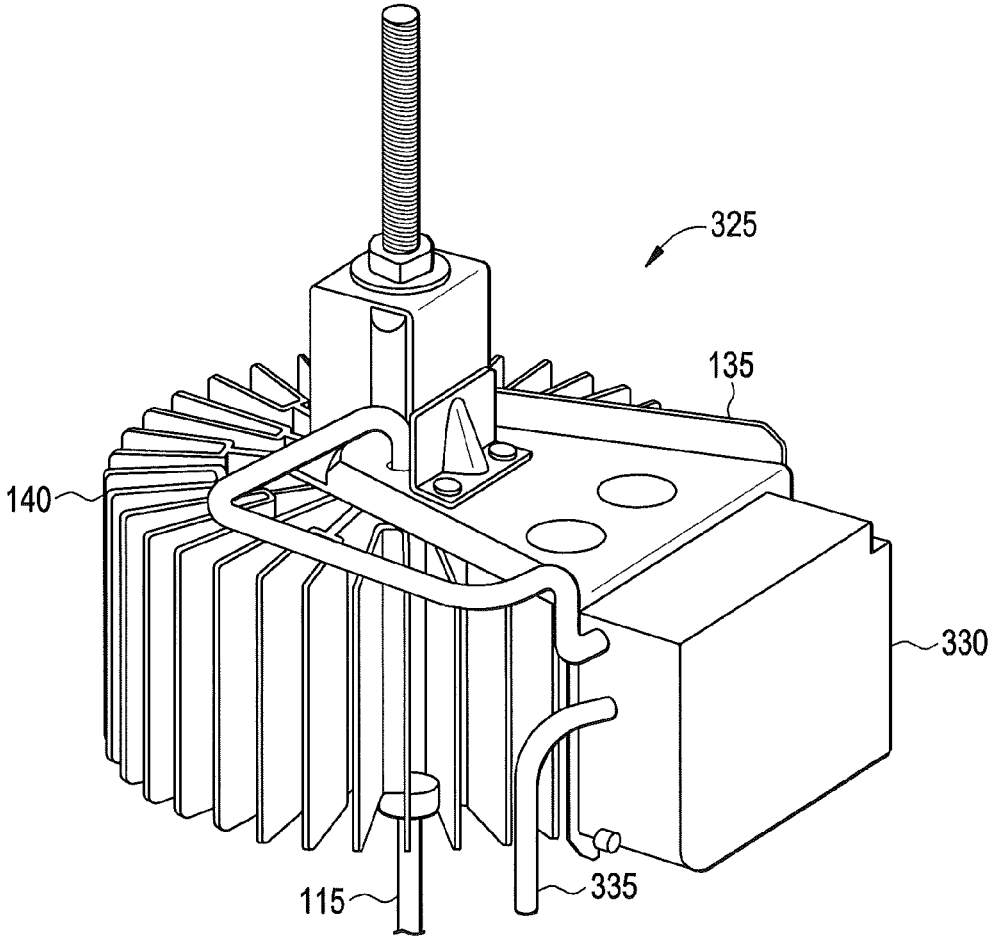
FIG. 17 depicts a portion of the light emission module showing a power supply and a secondary power lead in accordance with an embodiment of the invention.

Referring now to FIG. 17, which depicts a portion 325 of light emission module 110 (heat sink 140, partial support 135, central power lead 115, for example), in addition to a power supply 330 and a secondary power lead 335 (also illustrated in FIGS. 3 and 5). The centrally disposed power lead 115, which typically provides ac (alternating current) power from a utility, passes up through the center of light emission module 110, as discussed above, and is connected to the power supply 330, which in turn converts the ac power to dc (direct current) power for powering the LED's 185. The secondary power lead 335 is connected to the LED board 150 via contact pad 320 (see FIG. 15). In addition to the power supply 330, a surge suppressor 340 (see FIGS. 3 and 5) may be employed as part of the light emission module 110 in a manner known in the art for providing surge protection to the LED board 150.

As illustrated in FIG. 17, an embodiment includes the power supply 330 being structurally connected with support 135 of the light emission module 110. However, it will be appreciated that the power supply 330 may be positioned at any location in association with and suitable for the purpose of powering light 100 without departing from embodiments of the invention disclosed herein. As such, all such locations for power supply 330 are contemplated and considered within the scope of inventions disclosed herein.

With regard to orientation, the light emission module 110 may be disposed in the base 125 of light fixture 105 with light emission therefrom being oriented in an upward direction away from the street or ground, or may be disposed in the top 130 of light fixture 105 with light emission therefrom being oriented in a downward direction toward the street or ground. In the base arrangement with light emission upward, the central power lead 115 may connect directly to the power supply 330 without having to pass through the heat sink 140, LED board 150 or monolithic optic 160, and in the top arrangement with light emission downward, the centrally disposed power lead 115 is disposed so as to minimize lead interference with light emission from the LED board 150 and monolithic optic 160. In either orientation, the light emission module 110 configured to receive a centrally arranged power lead 115 as disclosed herein provides light emission advantages not otherwise provided by existing LED type light fixtures that may also be suitable for street lighting.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims.

Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A light fixture useful for area lighting, the light fixture comprising:

a housing comprising a base and a top; and a light emitting diode (LED) light emission module disposed within the housing, the light emission module having an LED board, the LED board comprising a monolithic substrate having a first side and a second side, the first side comprising a plurality of LEDs arranged in groups, each group being defined by a separate subset of the plurality of LEDs, each group of LEDs being electrically connected in parallel with each other group, and each of the LEDs within a group being electrically connected in series with each other LED within the respective group;

wherein the light emission module comprises a centrally disposed aperture that receives a centrally disposed power lead for powering the light emission module.

2. The light fixture of claim 1, wherein:

the light emission module is disposed at least partially in the base with light emission therefrom being oriented in an upward direction away from the ground.

3. The light fixture of claim 1, wherein:

the light emission module is disposed at least partially in the top with light emission therefrom being oriented in a downward direction toward the ground.

4. The light fixture of claim 1, wherein the light emission module comprises:

a support;

a heat sink coupled to the support;

an LED board coupled to the heat sink, the LED board having a plurality of LEDs disposed on a first side; and a monolithic optic disposed proximate the LED board;

wherein at least one of the optic, the LED board, the heat sink and the support comprises a centrally disposed aperture that receives the centrally disposed power lead for powering the light emission module.

5. The light fixture of claim 4, wherein the optic and the LED board each comprise a centrally disposed aperture that receives the centrally disposed power lead for powering the light emission module.

6. The light fixture of claim 4, wherein the LED board comprises a thermally conductive layer disposed on a second side opposite to the first side, the thermally conductive layer being disposed adjacent to and in thermal communication with the heat sink.

7. The light fixture of claim 4, wherein:

at a plane defined by an interface of the LED board and the heat sink, the LED board has an outside profile that is equal to or greater than an outside profile of the heat sink.

8. The light fixture of claim 4, wherein:

the light emission module is disposed in the housing with light emission therefrom being oriented downward toward the ground;

the LED board comprises a plurality of LEDs, and the monolithic optic comprises a plurality of lenses, each of the lenses being associated with a corresponding one of the LEDs; and each lens and corresponding LED has a same emission pattern oriented in a same direction that produces a Type-III emission pattern on the ground.

9. The light fixture of claim 1, further comprising a light transmissible encapsulate disposed over each of the LEDs.

10. The light fixture of claim 1, wherein:

light emission from all LEDs within a given group is lost in response to one of the LEDs within the given group being non-functional.

11. The light fixture of claim 1, wherein the plurality of LEDs comprises sixty LEDs arranged in six groups of ten LEDs.

12. The light fixture of claim 1, wherein the plurality of LEDs comprises six triangular shaped groups of LEDs arranged in a hexagon pattern.

13. The light fixture of claim 1, wherein each of the plurality of LEDs are disposed such that light emission from each LED is directed in a same direction.

14. The light fixture of claim 1, further comprising a thermally conductive layer disposed on the second side of the monolithic substrate.

15. The light fixture of claim 1, wherein each group of LEDs has a same number of LEDs.

16. The light fixture of claim 1, wherein the monolithic substrate comprises a centrally disposed aperture that receives the centrally disposed power lead for powering the plurality of LEDs.

17. A light fixture useful for area lighting, the light fixture comprising:

a housing comprising a base and a top; and light emitting diode (LED) light emission module disposed within the housing, the light emission module having a monolithic optic comprising:

a common platform having a first side oriented towards LEDs of the light emission module, and a second side oriented away from the LEDs of the light emission module; and a plurality of convex lenses disposed on the second side in a one-to-one corresponding relationship with respect to the plurality of LEDs.

18. The light fixture of claim 17, further comprising an endless gasket-receiving feature disposed on the first side of the common platform proximate the perimeter of the common platform.

19. The light fixture of claim 17, wherein:

the monolithic optic comprises a centrally disposed aperture that receives the centrally disposed power lead for powering the plurality of LEDs.

20. The light fixture of claim 17, wherein each of the lenses comprises respective portions that direct light in a same direction.

21. The light fixture of claim 17, wherein each of the lenses have a same first cross-section and a same second cross-section, the first and second cross-sections being orthogonal to each other.

22. The light fixture of claim 21, wherein the first cross-section has a centrally disposed dimple on the first side of the common platform and two symmetrically disposed convex lobes on the second side of the common platform.

23. The light fixture of claim 22, wherein the second cross-section has a non-centrally disposed dimple on the first side of the common platform and a single asymmetrically disposed convex lobe on the second side of the common platform.

24. The light fixture of claim 1, further comprising:

a power supply, that converts ac power to dc power, disposed in electrical communication with the LEDs of the light emission module.

25. The light fixture of claim 24, wherein the light emission module comprises the power supply, the light emission module and the power supply being rigidly connected to each other.

* * * * *